US005103875A

United States Patent [19]

Tate et al.

[11] Patent Number: 5,103,875

[45] Date of Patent: Apr. 14, 1992

[54] WEFT-WEAR PAPER MAKER'S FABRIC WITH SHORT AND LONG WEFT CRIMPS

[75] Inventors: Takuo Tate, Hachiouji; Taketoshi Watanabe; Hiroyuki Nagura, both of Inagi, all of Japan

[73] Assignee: Nippon Filcon Co., Ltd., Tokyo, Japan

[21] Appl. No.: 562,400

[22] Filed: Aug. 3, 1990

Related U.S. Application Data

[63] Continuation-in-part of Ser. No. 358,445, May 26, 1989.

[30] Foreign Application Priority Data

Jun. 9, 1988 [JP] Japan ..... 63-140403

[51] Int. Cl.[5] ..... D03D 13/00

[52] U.S. Cl. ..... 139/383 A

[58] Field of Search ..... 139/383 A

[56] References Cited

U.S. PATENT DOCUMENTS 4,149,571 4/1979 Burroughs .
4,499,927 2/1985 Borel ..... 139/383 A X
4,554,953 11/1985 Borel et al. ..... 139/383 A
4,702,952 10/1987 Borel ..... 139/383 A X
4,789,009 12/1988 Troughton ..... 139/383 A

FOREIGN PATENT DOCUMENTS 0010311 4/1980 European Pat. Off. .
0080686 11/1982 European Pat. Off. .
0259294 7/1987 European Pat. Off. .
451752 8/1936 United Kingdom .

*Primary Examiner*—Andrew M. Falik
*Attorney, Agent, or Firm*—Bucknam and Archer

[57] ABSTRACT

A weft-water type n-shaft papermakers' fabric has a running side surface and a papermaking side surface, in which n is an integer of at least 6. The fabric has warps and wefts forming the running side surface, the wefts consisting of both short crimp-forming wefts, which cross two or more warps, and long crimp-forming wefts which have a length more than 1.5 times the length of the short crimp. The improvement in crimpiness permits the use of large wefts having a large diameter. The arrangement of the running side surface does not affect the papermaking side surface of a double layer, triple layer or other multilayer weave.

6 Claims, 18 Drawing Sheets

WEFT-WEAR PAPER MAKER'S FABRIC WITH SHORT AND LONG WEFT CRIMPS

This application is a continuation-in-part of U.S. Ser. No. 358,445 filed May 26, 1989, now abandoned.

BACKGROUND OF THE INVENTION

1. Field of the Invention

This invention relates to papermakers' fabrics.

2. Description of the Prior Art

There have heretofore been many requirements for papermakers' fabrics. The requirements may be roughly sorted into the following three groups:

Group I

Prevention of generation of wire marking, Sufficient tanglement of cellulosic fibers, and Problems as to the quality of paper or as to the retention of paper obtained;

Group II

Improvement in wear resistance of fabrics and

Extension of the service life thereof; and

Group III

Satisfactory drainage, and the like.

The requirements in the respective Groups are associated with one another in many respects. Roughly speaking, the problems in Group I are greatly associated mainly with the structure of the papermaking side surface of the fabric, the problems in Group II are mostly associated with the structure of the running side surface (which is the reverse side surface or roller side surface) of the fabric, and the problems in Group III are associated with the entire fabric.

Such problems must be solved in the field not only of multi-layer fabrics but also single layer fabrics.

There have heretofore been proposed many approaches to the solution of the problems in Group I. However, no sufficient efforts have been made to improve the papermakers' fabrics in wear resistance except that the running side of the fabric is made to take a wefts-wearing form only to prevent the warps of the fabric from being worn.

On the other hand, there have recently been made many requirements such as the speed-up of papermaking, an increase in amounts of filler used and an increased necessity of manufacture of neutral paper, and, in addition, a serious problem has been raised as to the wear resistance of the papermaking fabrics.

FIG. 5 is a complete design showing a conventionally used papermakers' fabric consisting of 16 warps, 16 upper wefts and 16 lower wefts. In the Figure, the symbol "O" shows a position where the warp interlaces with the weft of the running side surface in the fabric, and the symbol "X" shows a position where the warp interlaces with the weft of the papermaking side surface. Accordingly, the distance between two adjacent "O" symbols indicates the length of one crimp of the weft in the running side surface. In the conventional papermakers' fabrics of FIG. 5, the adjacent two wefts in the running side surface are the same in length of crimp (or crimped portion).

In such conventional papermakers' fabrics, it has been attempted to use wefts having a large diameter in the running side surface to meet such requirements as the above, to improve the fabrics in wear resistance to some extent. In this case, however, the balance between the wefts and the warps is lost since the former are bigger in diameter than the latter, thus deteriorating the crimpiness and generating wire marking.

As will be understood from the problems in said Group III, a change in the structure of the running side surface will also affect the drainage, and the problems will not be solved by a mere makeshift measure such as the use of wefts having a bigger diameter.

SUMMARY OF THE INVENTION

In view of the conventional technical problems, this invention contemplates the improvement of papermakers' fabrics in wear resistance without impairing papermaking performances of the papermakers' fabrics such as the drainage thereof.

The primary object of this invention is to provide papermakers' fabrics which have satisfactory runability (posture or shape retentivity) and conspicuously improved wear resistance, without affecting any adverse effects on the papermaking side surface of the fabric, by arranging wefts having long crimps and wefts having short crimps in the running side surface of the papermakers' fabric.

The papermakers' fabric of the present invention is a weft-wear type n-shaft papermakers' fabric having an running side surface and a papermaking side surface, wherein n is an integer of at least 6, which comprises warps, and wefts forming the running side surface to provide the wear-resistant surface of the papermakers' fabric, the wefts consisting of short crimp-forming wefts, said short crimp crossing two or more warps, and long crimp-forming wefts, said long crimp having a length more than 1.5 times as long as that of said short crimp.

According to this invention, this arrangement is made on the running side surface of the papermakers' fabric, and, therefore, it will not affect the papermaking side surface at all in papermakers' fabrics of a double layer, triple layer or other multi-layer weave. Even in papermakers' fabrics of a single layer weave, the above arrangement will hardly affect the papermaking side surface and will not substantially change the drainage and anti-wire marking property of the fabric.

The wear resistance of the running side surface of a papermakers' fabric will be increased by enlarging the to-be-worn volume of to-be-worn yarns which form the running side surface of the fabric. From the standpoint of the runability of a fabric in use and the extension of service life of the fabric, it is desirable that the wefts of the fabric be made to exert anti-wear actions. The reason for this is that the fabric will change in dimensions and will be torn off when the warps are worn.

The papermakers' fabrics of this invention are such that the volume to be worn is increased by using a weft having long crimps, for example, every other weft in the running side surface thus improving the fabrics in wear resistance without changing the papermaking side surface properties such as a pulp fibers-supporting property and anti-wire marking property.

In fact, in knuckles formed by interlacing the warps with the wefts to sharply bend these yarns, there exist weft portions which do not exert anti-wear actions because of the configuration of crimp of the yarns. In other words, the smaller the number of knuckles in a fixed area is, the larger an effective to-be-worn volume becomes, from the viewpoint of wear resistance. Further, in this case, the drainage also improves.

In addition, crimpiness which is an indication of the warps' capability of overcoming the repulsive force of the wefts and press bending the wefts, when it is attempted to make the warps bend the wefts, will be improved by using warps which are such that the distance (or space) between two adjacent warps is long in the fabric. The improvement in crimpiness permits the use of large wefts having a large diameter. In this invention, the wefts forming long crimps are arranged in the running side surface of the fabric to ensure satisfactory crimpiness, and, therefore, this invention permits the use of large wefts, which have not heretofore been used, in the fabric whereby the volume to be worn can further enlarged.

The above functions will be generally explained with reference to FIGS. 6 to 8.

FIGS. 6 and 7 show the knuckles of a papermakers' fabric in which reference characters a–f each designates a warp and reference characters a' and b' each designates a weft which crosses the warps and takes a part in the formation of the running side surface of the fabric. FIG. 6 shows that the warp b passes over the weft a' and the warp b does not interlace with the weft a'. FIG. 7 shows that the warp e passes beneath the weft b' to interlace with the latter thereby forming knuckle. It is apparent that the hatched portions in FIGS. 6 and 7 do not exert wear-resisting actions. In other words, with the increase of number of such knuckles, weft portions having no wear-resisting function increase thus decreasing an effective volume to be worn.

FIG. 8 shows the shape or configuration of a crimp. Warps g and k pass beneath a weft c' to interlace with the weft c'. As is apparent from this Figure, the warps g and k push upward the weft c'. In addition, the warps h and j suffer the repulsive force from the weft c' and conversely push downward the weft. A warp i also pushes downward the weft c', but its pushing-down action is weak as compared with that of the warp h or j.

The tendency of these warps to overcome the repulsive force of the weft and press bend the weft, is called crimpiness. Thus, satisfactory crimpiness permits the use of large wefts.

As will be understood from the configuration of the crimp in FIG. 8, the longer the distance between the warps g and k is and the larger the number of the warps h, i, j ---is, the better the crimpiness is.

Since, according to this invention, the wefts forming the running side surface of the papermakers' fabric are differentiated in the length of crimp, large wefts can be also used as wefts having long crimps thus providing a large volume to be worn in the fabric.

Among the wefts forming the running side surface of papermakers' fabric of the present invention, each of short crimps formed with short crimp-forming wefts cross two or more warps. Because, when the short crimp crosses only one warp, the warp is more prominently protruded toward the running side surface than the weft at a knuckle portion, so that the warp tends to be worn out at first. If warps of a fabric (warp-wear type fabric) are worn out, the fabric is easily torn off. In contrast to that, when the short crimp of a weft crosses two or more warps, the warp does not tend to protrude toward the running side surface in preference to the weft, so that the yarn to be worn out at first is the weft rather than the warp. Even if wefts of a fabric (weft-wear type fabric) are worn out, the fabric is not torn off as long as warps are not worn out, so that in that case the service life of the fabric can be prolonged.

Each long crimp formed with long crimp-forming wefts of the papermakers' fabric of the present invention should have a length more than 1.5 times, preferably twice or more as long as that of the short crimp.

If the length of the long crimp is only 1.5 times or less as long as that of the short crimp, the to-be-worn volume of the weft forming the running side surface is not sufficiently enlarged, so that it would be difficult to sufficiently realize the effect of the present invention, i.e. improvement of the wear resistance of the fabric. Further, when the length of the long crimp has a length, which is twice or more as long as that of the short crimp, the above effect of the present invention will more easily be realized.

It is also required that the papermakers' fabric of the present invention should be of 6-shaft or more.

A weft-wear type papermakers' fabric having the construction as explained above, wherein each of short crimps crosses two or more warps, and the length of each of long crimps is more than 1.5 times as long as that of the short crimp, can be realized only with the fabric of 6-shaft or more.

Further, the construction wherein the fabric is of 6-shaft or more, is imperative in realizing the improvement of wear resistance of the papermakers' fabric without badly affecting the papermaking performances such as the anti-wiremarking properties, fibers-supporting property, drainage and runability.

An increase in the volume to be worn will be concretely explained in comparison with a Comparative Example, in the following Examples.

The effects of this invention are applicable to papermakers' fabrics of a single layer, double layer or other multi-layer weave.

DESCRIPTION OF THE PREFERRED EMBODIMENTS

This invention will be better understood by the following Examples.

EXAMPLES

Figure 1:
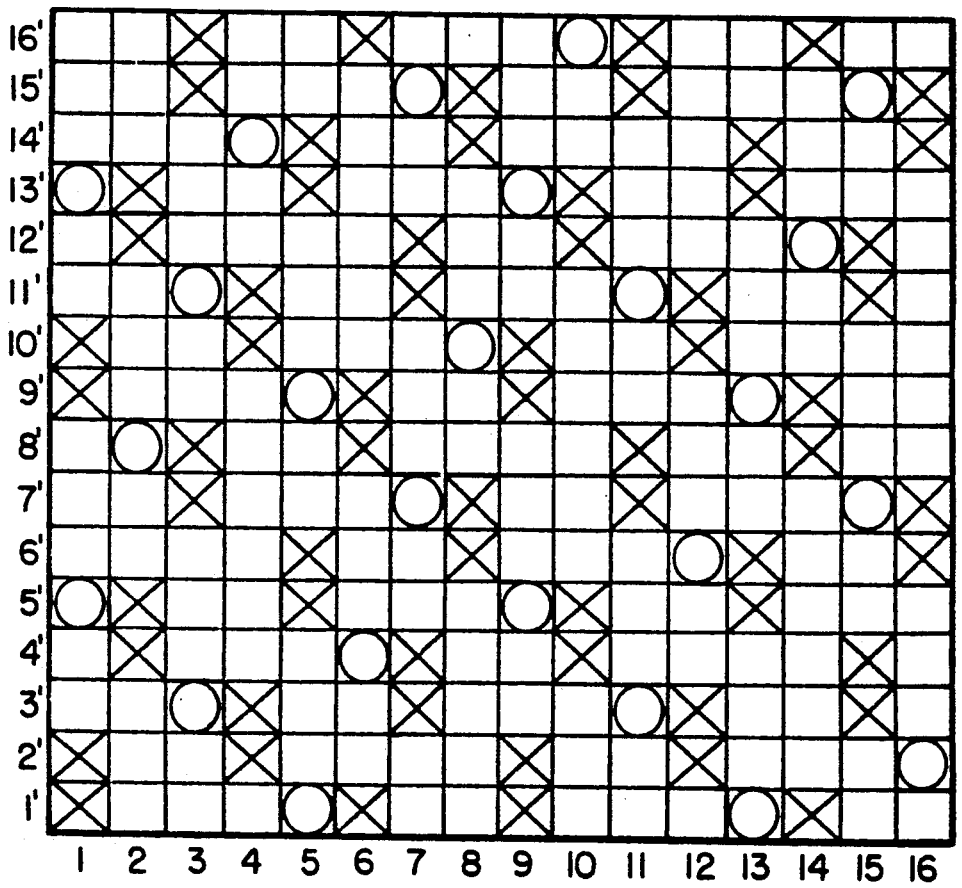
FIG. 1 is a complete design (one repeat) of a papermakers' fabric of a double layer weave consisting of 16 warps, 16 upper wefts and 16 lower wefts according to this invention.
Figure 1A:
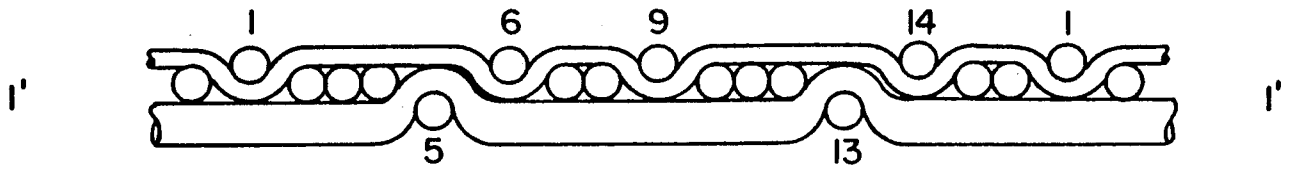
FIGS. 1*a* and 1*b* are drawings showing wefts 1' and 2' cross sections of the fabric of FIG. 1, respectively.
Figure 1B:
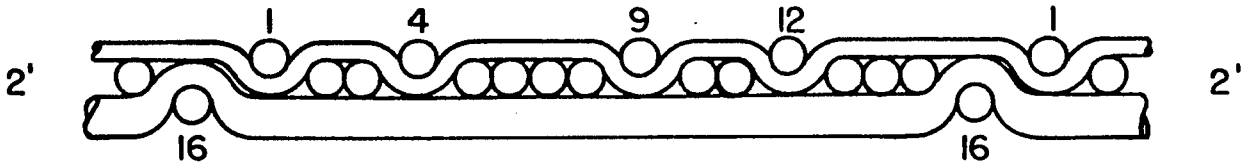
Figure 2:
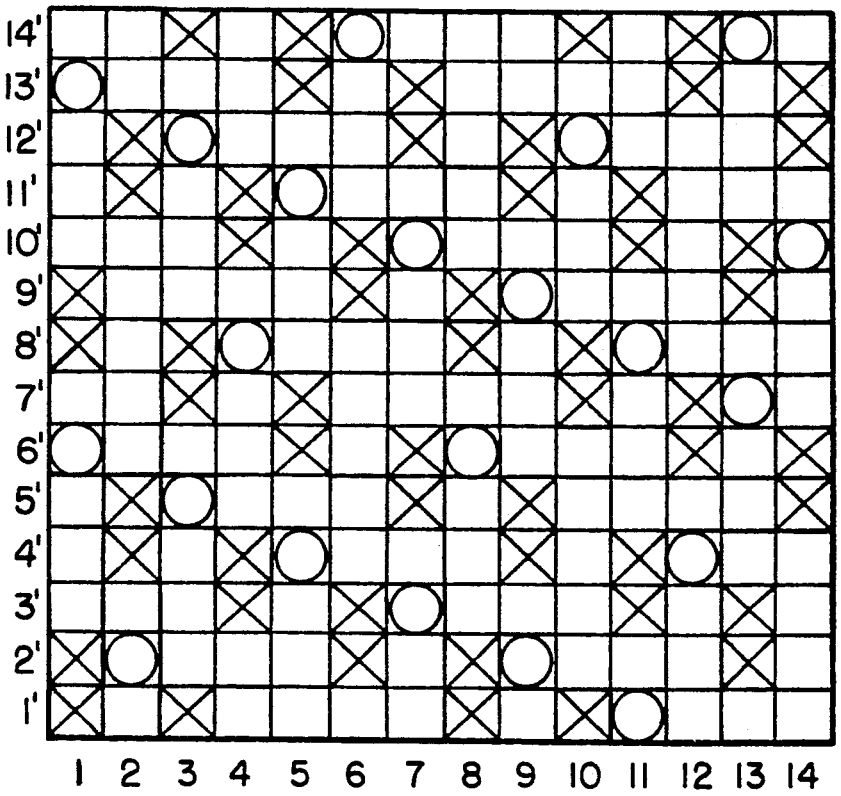
FIG. 2 is a complete design of a papermakers' fabric of a double layer weave consisting of 14 warps, 14 upper wefts and 14 lower wefts according to this invention.
Figure 3:
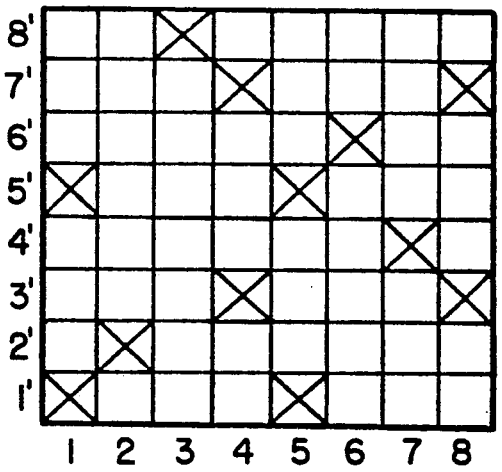
FIG. 3 is a complete design showing the reverse side of a papermakers' fabric of a single layer 3/1 broken satin weave consisting of 8 warps and 8 wefts according to this invention.
Figure 2A:
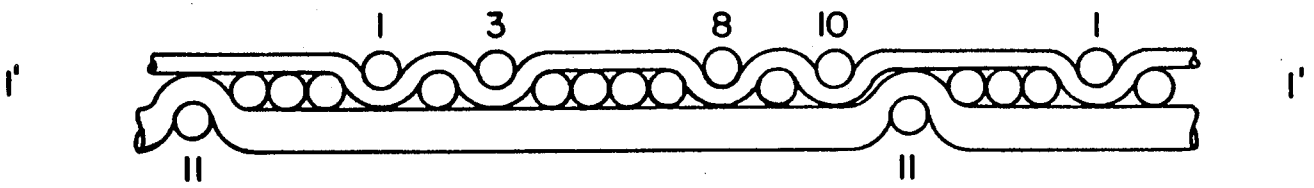
FIGS. 2*a* and 2*b* are drawings showing wefts 1' and 2' cross sections of the fabric of FIG. 2, respectively.
Figure 2B:
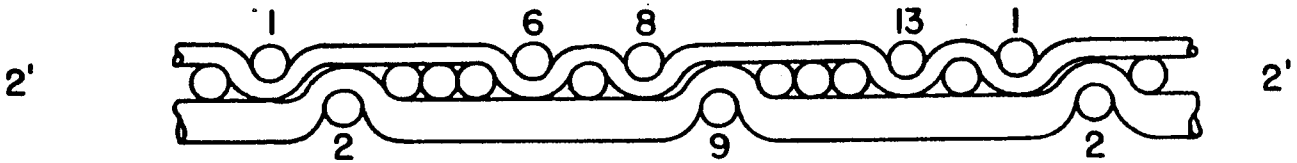
Figure 4A:
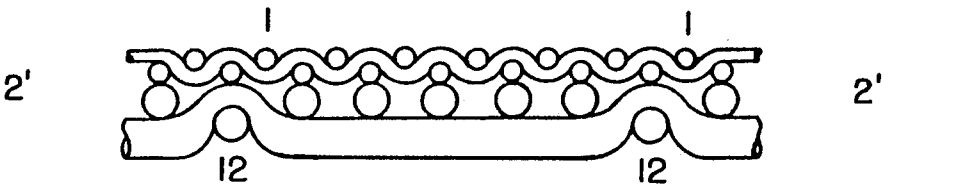
FIGS. 4*a* and 4*b* are drawings showing wefts 2' and 4' cross sections of the fabric of FIG. 4, respectively.
Figure 4B:
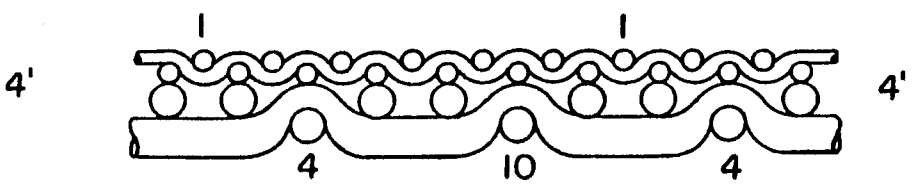
Figure 3A:
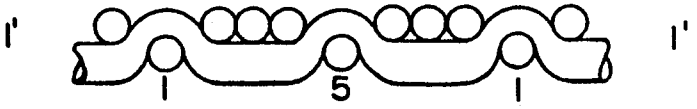
FIGS. 3*a* and 3*b* are drawings showing wefts 1' and 2' cross sections of the fabric of FIG. 3, respectively.
Figure 3B:
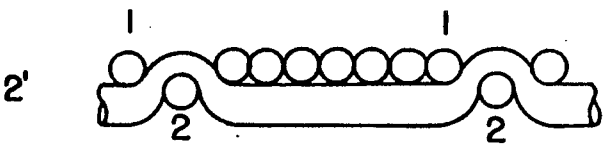
Figure 4:
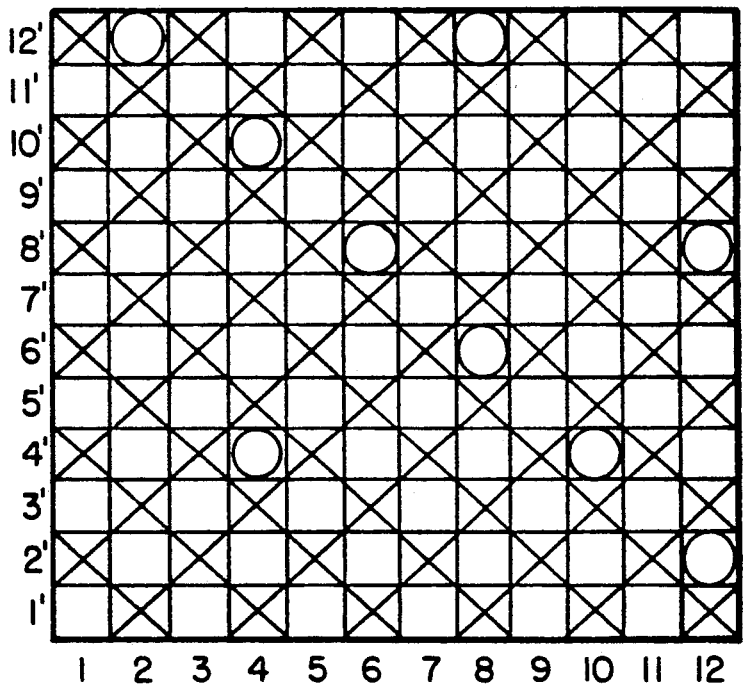
FIG. 4 is a complete design of a papermakers' fabric of a triple layer weave consisting of 12 upper warps, 6 lower warps, 12 upper wefts and 6 lower wefts according to this invention.

In FIGS. 1, 2 and 4, the symbol "O" indicates a position where the warp interlaces with the weft in the running side surface, the symbol "X" indicates a position where the warp interlaces with the weft in the papermaking side surface, and a blank square indicates a position where the warp interlaces with neither the weft in the running side surface nor the weft in the papermaking side surface. In FIG. 3, the symbol "X" indicates a position where the warp interlaces with the weft in the running side surface.

Thus, in a case where the crimp is short, the distance between the adjacent symbols "O" in each of FIGS. 1, 2 and 4 (or the distance between the adjacent symbols "X" in FIG. 3) indicates the length of one crimp of the wefts which form the running side surface of the papermakers' fabric. In a case where the crimp is long, the distance between the symbol "O" in each of the complete designs of FIGS. 1, 2 and 4 and the symbol "O" in the adjacent repeating complete design (not shown) indicates the length of one crimp of the wefts which form the running side surface, this being also applicable to the distance between the symbols "X" in FIG. 3.

As is apparent from FIGS. 1, 1*a*, 1*b*, 2, 2*a*, 2*b*, 3, 3*a*, 3*b*, 4, 4*a*, and 4*b*, every other weft has long crimps; the long crimps themselves are the same in length, while the short crimps themselves are the same in length.

Further, the fabrics shown in each of FIGS. mentioned above are of 6-shaft or more, wherein each of short crimps of the wefts forming the running side surface crosses two warps or more, and the length of each of long crimps is more than 1.5 times as long as that of the short crimp.

As will be seen from FIGS. 9, 10, 11 and 12, wefts which are used in the formation of the running side surface and whose crimps are different in length from one another, may not be arranged adjacent to one another in the fabric and such wefts having crimps of different length may not be arranged in equal number.

Figure 9:
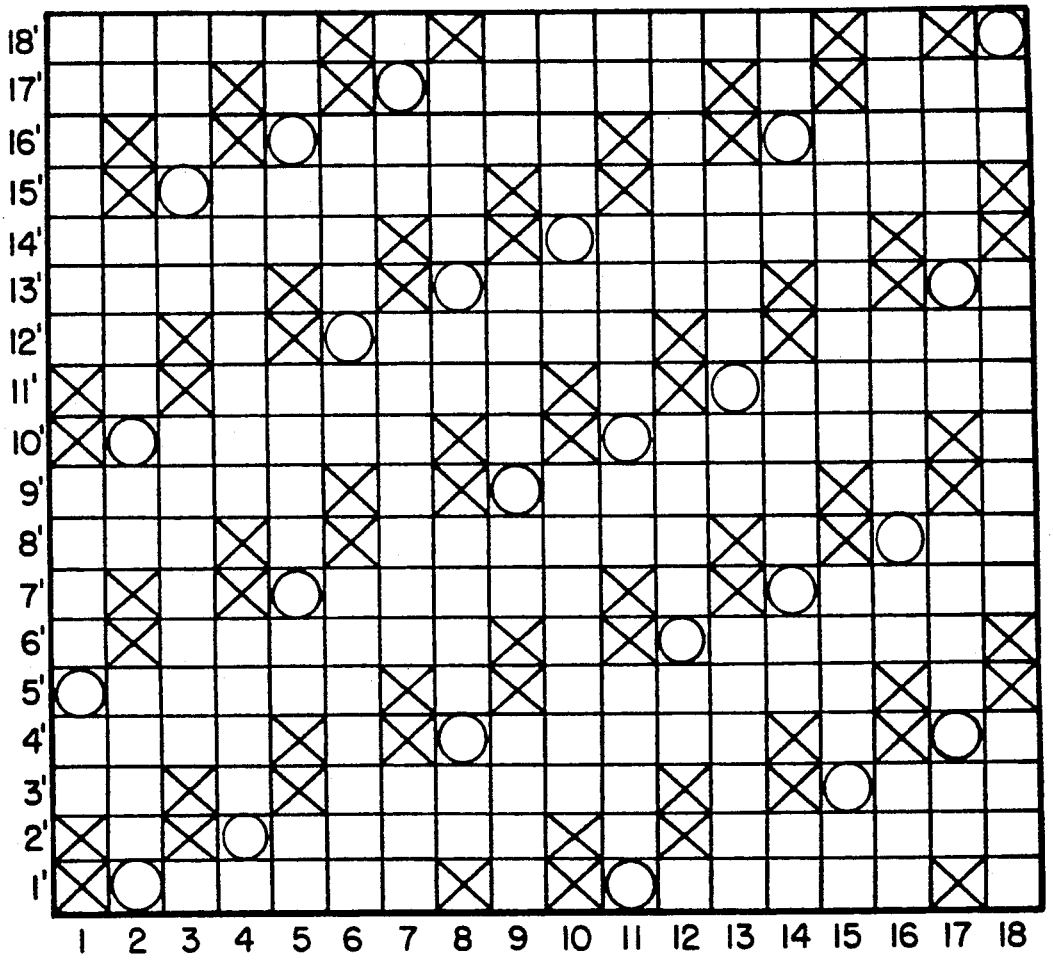
FIG. 9 is a complete design of a papermakers' fabric of a 18-shaft 2:1 mixture weave (mixedly woven fabric) according to this invention.
Figure 9A:
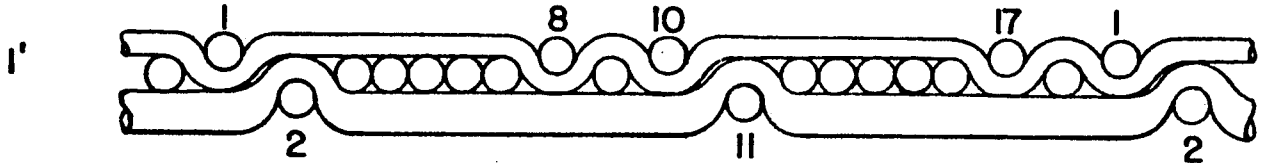
FIGS. 9*a* and 9*b* are drawings showing wefts 1' and 2' cross sections of the fabric of FIG. 9, respectively.
Figure 9B:
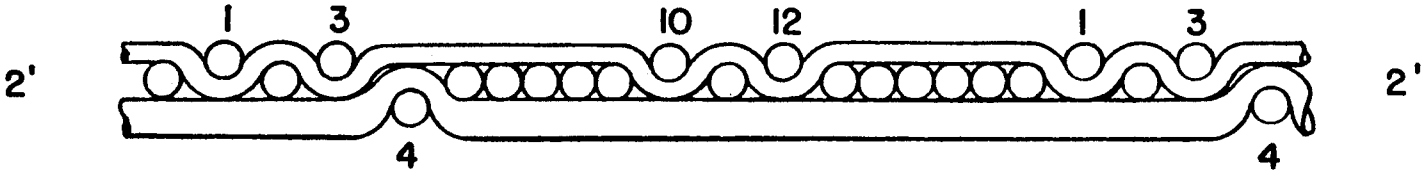

FIG. 9 shows a papermakers' fabric of a 18-shaft 1:2 mixture weave (namely, a weave of 18-shaft wherein the mixing ratio of the weft having long crimps to the weft having short crimps on the running side is 1:2) according to this invention in which two wefts having long crimps (the wefts being hereinafter referred to as "long crimp-forming wefts") and one weft having short crimps (the wefts being hereinafter referred to as "short crimp-forming wefts) are alternately arranged. It is understood from this Example of FIGS. 9, 9*a* and 9*b* that the long crimp-forming wefts each cross 17 of the warps (between the two adjacent "O" positions), while the short crimp-forming wefts each cross 8 of the warps.

Figure 10:
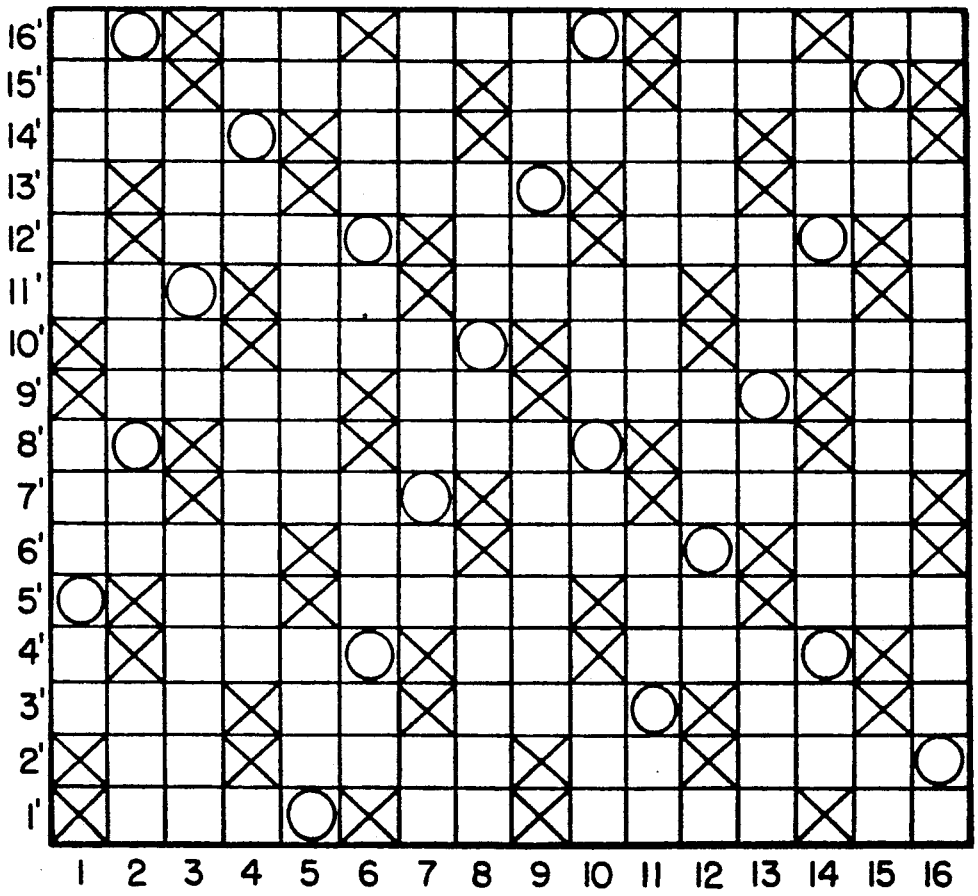
FIG. 10 is a complete design of a papermakers' fabric of a 16-shaft 3:1 mixture weave according to this invention.
Figure 10A:
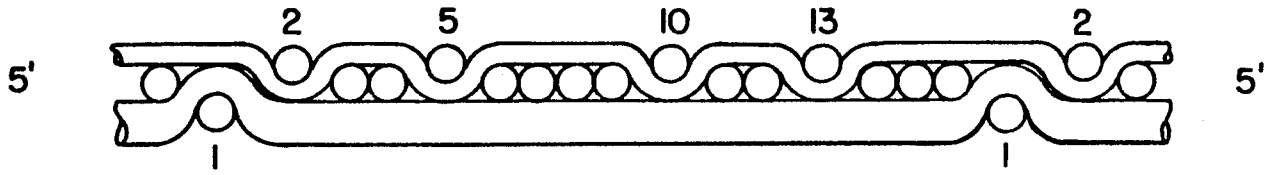
FIGS. 10*a* and 10*b* are drawings showing wefts 5' and 8' cross sections of the fabric of FIG. 10, respectively.
Figure 10B:
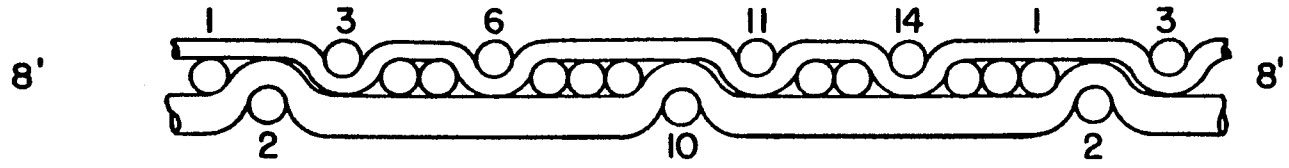

FIG. 10 shows a papermakers' fabric of a 16-shaft 1:3 mixture weave wherein 3 long crimp-forming wefts and 1 short crimp-forming weft are alternately arranged. It is understood from this Example of FIGS. 10, 10*a* and 10*b* that the long crimp-forming wefts each cross 15 warps (between the two adjacent "O" positions), while the short crimp-forming wefts each cross 7 warps.

Figure 11:
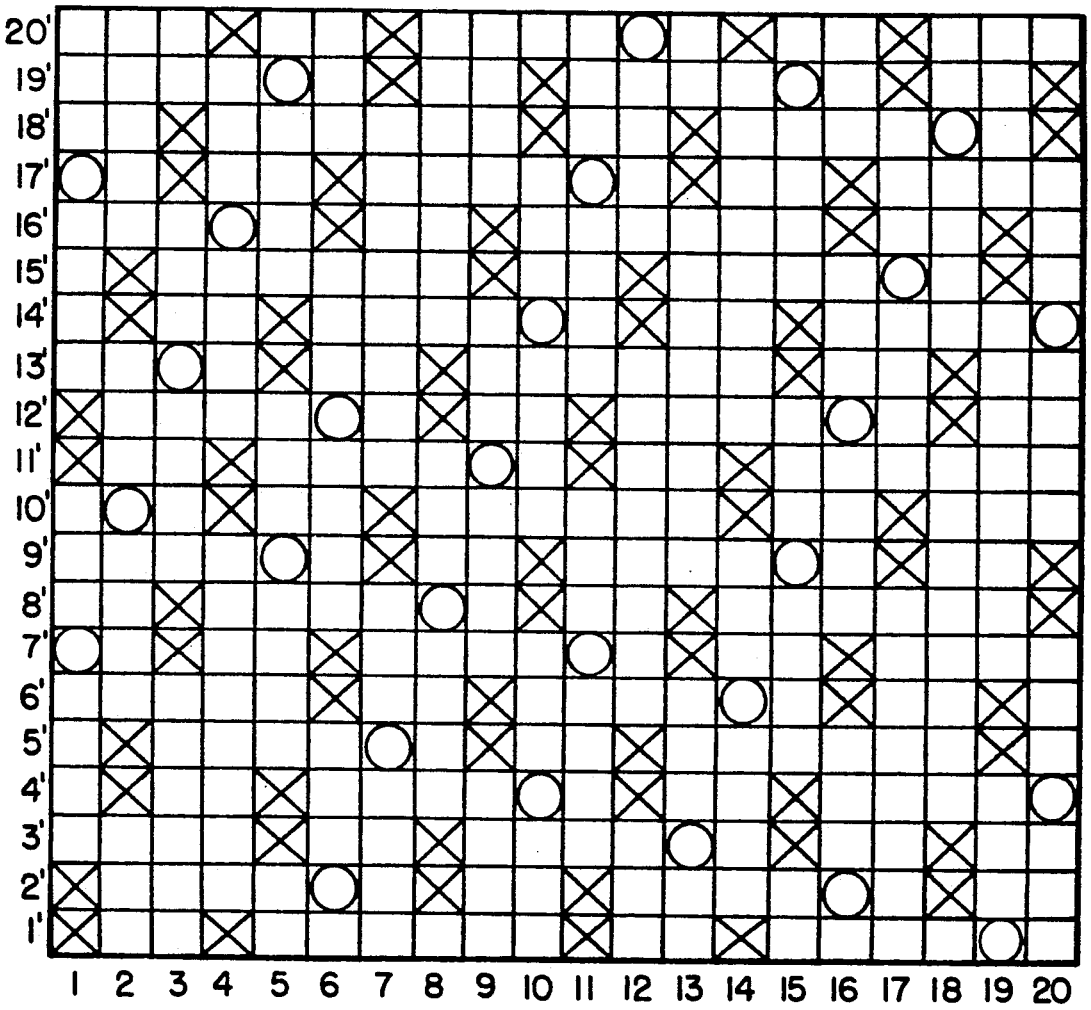
FIG. 11 is a complete design of a papermakers' fabric of a 20-shaft 3:2 mixture weave according to this invention.
Figure 11A:
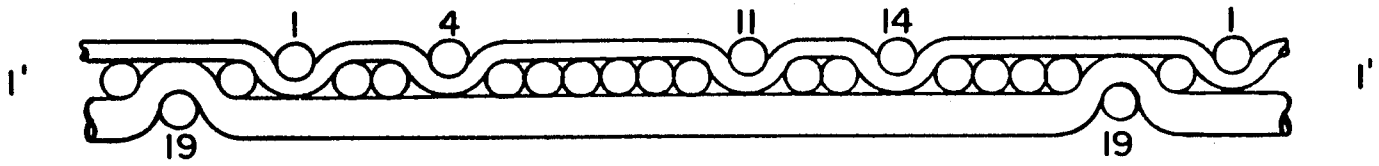
FIGS. 11*a* and 11*b* are drawings showing wefts 1' and 7' cross sections of the fabric of FIG. 11, respectively.
Figure 11B:
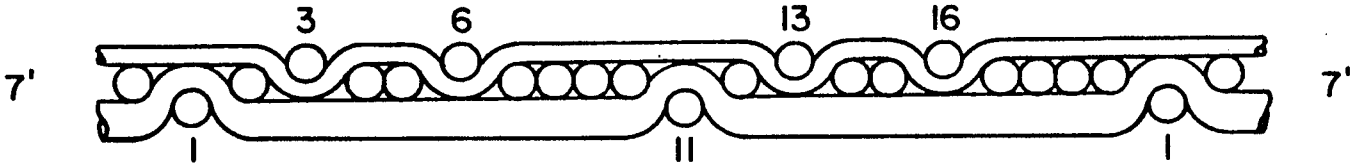

FIG. 11 shows a papermakers' fabric of a 20-shaft 3:2 mixture weave in which the long crimp-forming wefts and short crimp-forming ones are used in a ratio of 3:2. In this Figure, the wefts 1', 3', 5', 6', 8', 10', 11', 13', 15', 16', 18' and 20' have long crimps.

Figure 12:
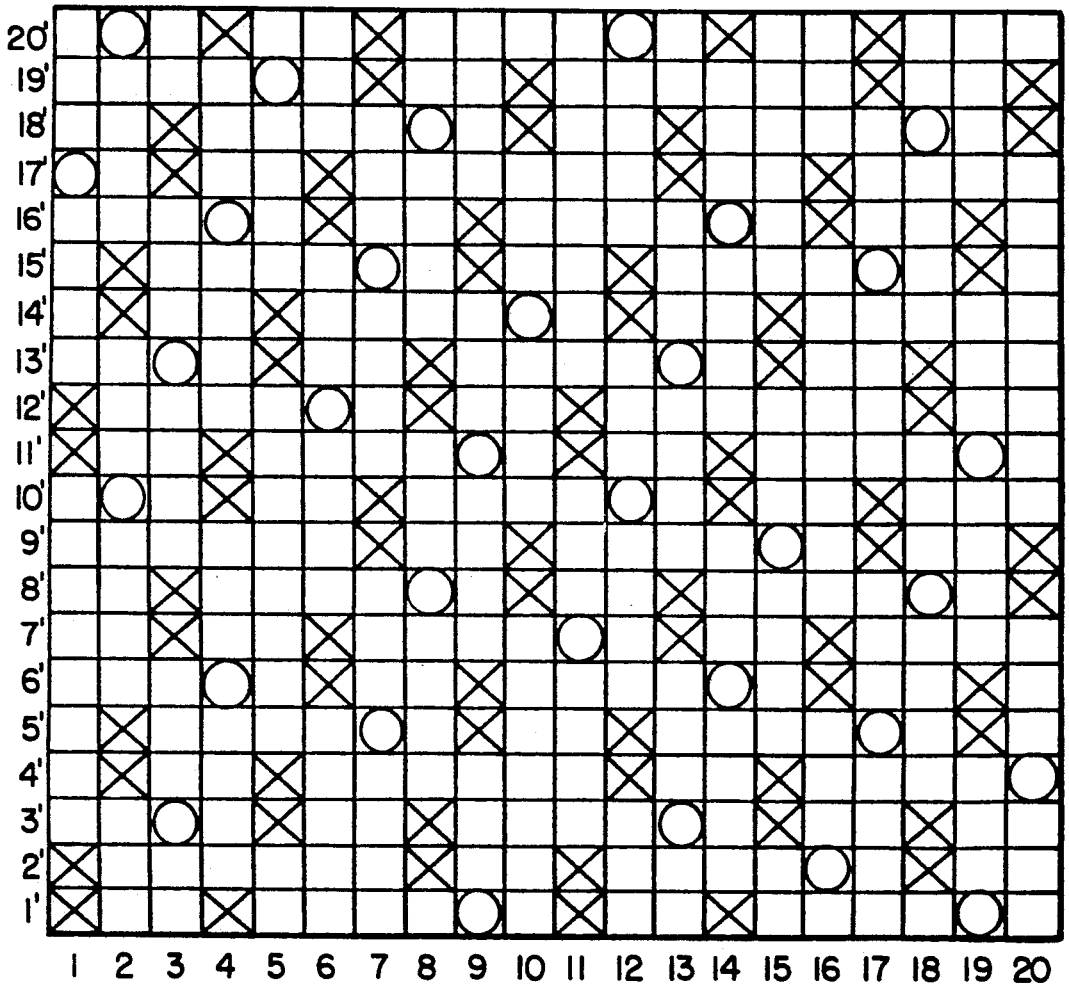
FIG. 12 is a complete design of a papermakers' fabric of a 20-shaft 2:3 mixture weave according to this invention.
Figure 12A:
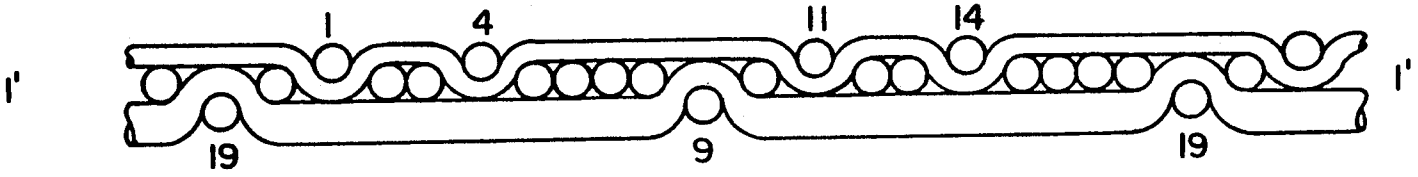
FIGS. 12*a* and 12*b* are drawings showing wefts 1' and 4' cross sections of the fabric of FIG. 12, respectively.
Figure 12B:
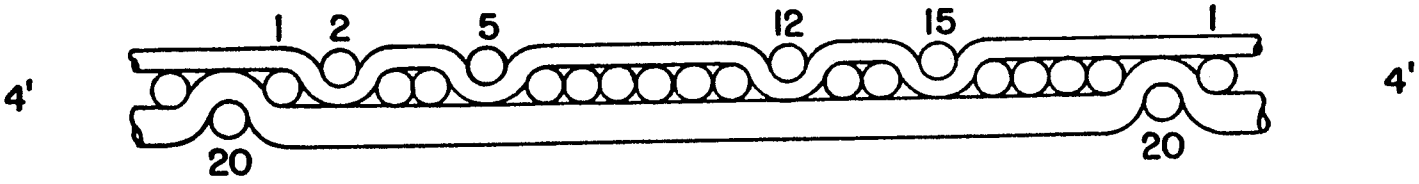

FIG. 12 shows a papermakers' fabric of a 20-shaft 2:3 mixture weave in which the long crimp-forming wefts and the short crimp-forming ones are used in a ratio of 2:3. In this Figure, the wefts 2', 4', 7', 9', 12', 14', 17' and 19' have long crimps.

The fabrics shown in each of FIGS. 9–12 are also of 6-shaft or more, wherein each of short crimps of the wefts forming the running side surface crosses two warps or more, and the length of each of long crimps is more than 1.5 times as long as that of the short crimp.

In the fabric of this invention as mentioned above, the long crimp-forming and short crimp-forming wefts forming the running side surface are used in a ratio of from 3:1 to 1:3 (this ratio including 2:1, 3:2, 1:1, 2:3 and 1:2). The reason for this is that the use of long crimp-forming wefts and short crimp-forming ones in a ratio of from 3:1 to 1:3, is preferable to improve the fabric in wear resistance and runability under the condition that these properties are balanced. More specifically, the long crimp-forming wefts are greatly effective in wear resistance, but they are not so effective in posture retentivity since they are not interlaced with the warps many times. On the other hand, the short crimp-forming wefts are greatly effective in posture retentivity, but they are not so effective in wear resistance. The use of the long crimp-forming and short crimp-forming wefts in a ratio of larger than 3:1 will undesirably deteriorate the fabric in runability, whereas the use thereof in a ratio of smaller than 1:3 will also undesirably worsen the fabric in wear resistance.

In a case where there are used the long crimp-forming wefts whose long crimps are identical in length with one another and the short crimp-forming ones whose short crimps are identical in length with one another in the preparation of a fabric, the long crimp-forming and short crimp-forming wefts forming the running side surface to provide a wear-resistant surface, the resulting fabric will be satisfactory in runability but it is not always necessary to use such wefts as mentioned above in order to improve the resulting fabric in wear resistance. It is important that the fabric comprises both long crimp-forming wefts effective in wear resistance and short crimp-forming ones effective in runability.

However, it is desirable in papermakers' fabrics of a single layer weave that the long crimps themselves are identical in length with one another and the short crimps themselves are identical in length with one another to exert no effects on the papermaking side surface.

As mentioned above, this invention makes it possible to enlarge the effective to-be-worn volume in the running side of the papermakers' fabric as compared with that of a conventional papermakers' fabric thereby to greatly improve the fabric in wear resistance. This will be substantiated by the following comparative test 1.

COMPARATIVE TEST 1

Figure 5:
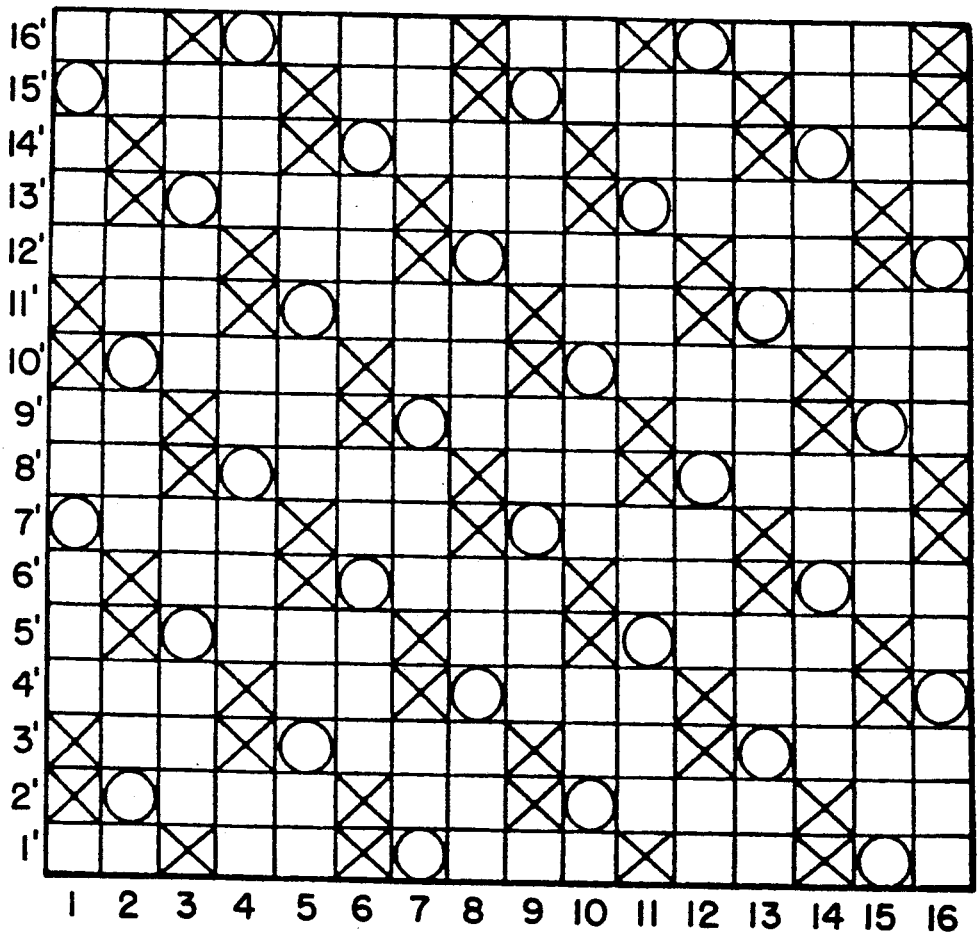
FIG.5 PRIOR ART
FIG. 5 is a complete design of a conventional papermakers' fabric (of the prior art) of a double layer weave consisting of 16 warps, 16 upper wefts and 16 lower wefts.
Figure 6:
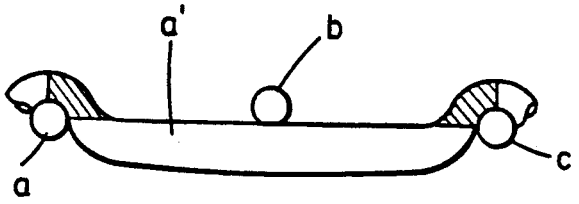
FIGS. 6 and 7 show the knuckles of a papermakers' fabric.
Figure 7:
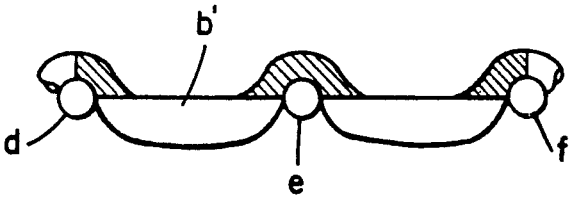
Figure 8:
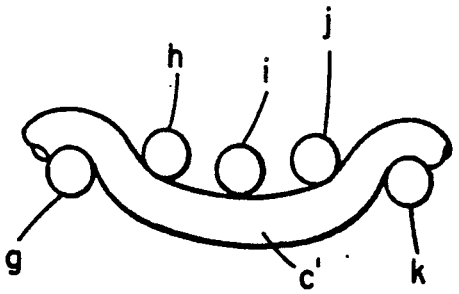
FIG. 8 shows the configuration of a crimp.

The papermakers' fabric of FIG. 1 which is typical of those of this invention, and the conventional papermakers' fabric of FIG. 5 are provided for comparing the wear resistance between these fabrics.

First of all, with regard to calculation of the volume of one crimp of the test wefts for comparison of the to-be-worn volume, the crimp is assumed to be in the cylindrical form between the warps. In fact, as mentioned later, the to-be-worn volume of the conventional fabric is smaller than that obtained by calculation since said volume includes portions which exist at the bent portions of the wefts and above the warps and are irrelevant to wear resistance. Since the long crimp-forming wefts and short crimp-forming ones are alternately arranged in the fabric according to this invention, the to-be-worn volume of crimps of the adjacent two wefts is calculated. In the comparative conventional fabric, the volume of crimps of the adjacent two wefts is also calculated. The two volumes obtained by calculation are compared with each other.

FIGS. 1 and 5 are each a complete design (one repeat) showing a papermakers' fabric consisting of 16 warps, 16 upper wefts and 16 lower wefts.

In FIG. 5 showing a conventional papermakers' fabric, the crimps of the adjacent wefts are the same in length. In the range of the complete design (one repeat) of FIG. 5, each weft forms two knuckles (symbol "O") with a warp and forms crimps whose total length is equal to twice the length of one crimp. There are arranged seven warps between the adjacent knuckles (in other words, one crimp extending from one knuckle to the adjacent knuckle crosses seven warps). Assuming that these seven warps are arranged in contact with one another, each weft in the range of this complete design (one repeat) is regarded as forming a crimp whose length is equal to 14 ($=7\times2$) times the diameter of warp, and the adjacent two wefts are regarded as forming crimps whose total length is equal to 28 ($=14\times2$) times the diameter of warp. Thus, assuming that the diameter of the warp is 0.17 mm and the diameter of the weft 0.22 mm, the total volume of crimps of the adjacent two wefts is as follows:

$$14\times2\times0.17\times(0.22/2)^2\pi=0.181\ \text{mm}^3$$

In contrast, in the complete design of FIG. 1 according to this invention, the long crimp-forming wefts and the short crimp-forming wefts are alternately arranged. As mentioned above, the short crimp-forming weft is regarded as forming two crimps and one crimp crosses 7 warps (in other words, seven warps are arranged over the length of one crimp); thus, assuming that these warps are arranged in contact with one another, the short crimp-forming weft forms a crimp whose length is 14 ($=7\times2$) times the diameter of warp. On the other hand, the long crimp-forming weft adjacent to the short crimp-forming weft forms one knuckle (represented by the symbol "0") in the range of the complete design of FIG. 1 and is regarded as forming one crimp which crosses 15 warps in view of said complete design being one repeat. Assuming that these 15 warps are arranged in contact with one another, the length of the crimp of the long crimp-forming weft is equal to 15 ($=15\times1$) times the diameter of the warp. The longer the crimp is, the better the crimpiness is, and this permits the use of wefts having a large diameter. Thus, assuming that the diameter of the warp is 0.17 mm, the diameter of the short crimp-forming weft 0.22 mm and the diameter of the long crimp-forming weft 0.25 mm, the volume of the adjacent two wefts can be calculated as shown in the following equation:

$$7\times2\times0.17\times(0.22/2)^2\pi+15\times0.17\times(0.25/2)^2\pi=0.216\ \text{mm}^3$$

Thus, an increase (in %) in to-be-worn volume is as follows:

$$(0.216\div0.181-1)\times100=19.3(\%)$$

The calculation, although a rough calculation, indicates that the fabric in the Example of this invention has a to-be-worn volume which is approximately 20% larger than the conventional.

The length of conventional crimp in the running side surface in FIG. 5 is found to be 1.105 mm by actual measurement, and the length according to this invention in FIG. 1 is 2.28 mm.

The results of the above comparative test are as shown in the following Table 1.

TABLE 1

| | Fabric of this invention | Conventional fabric |
|---|---|---|
| Dia. of warp (mm) | 0.17 (Polyester) | 0.17 (Polyester) |
| Dia. of upper weft (mm) | 0.17 (Polyester) | 0.17 (Polyester) |
| Dia. of lower weft (mm) | 0.22 (Polyester) | 0.22 (Polyester) |
| (1:1 mixture weave) | 0.25 (Polyamide) | 0.22 (Polyamide) |
| No. of warps (every 25 mm) | 155 | 155 |
| No. of lower wefts (every 25 mm) | 58 | 58 |
| Duration of lower wefts before being torn off by wear (hour) | 40 | 30 |

Test method: The test was effected by a wear tester (Japanese Utility Model Registration No. 1350124) produced by Nippon Filcon Co., Ltd., and heavy calcium carbonate was used as the filler.

Test results: As indicated in Table 1, the time (service life of wire) taken before the lower weft of the fabric of this invention was torn off by wear, was about 1.3 times that taken in the case of the conventional fabric.

COMPARATIVE TEST 2

Next, the following comparative tests are conducted to demonstrate the fact that the papermakers' fabric of the present invention has a higher wear resistance to that of the fabric having a construction different from that of the present invention.

First, fabrics shown in FIGS. 13–16 are manufactured, and then subjected to the following tests to evaluate the service life of the fabrics and the smoothness of paper to be produced.

Figure 13:
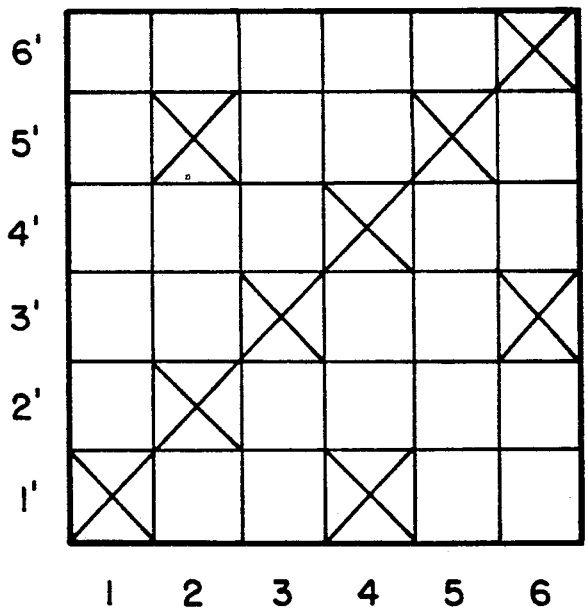
FIG. 13 is a complete design of the running side fabric of the fabric of the present invention shown in FIG. 4 (a 6-shaft papermakers' fabric of a single layer twill weave of the present invention)

FIG. 13 is a complete design of the running side fabric of the fabric of the present invention shown in FIG. 4 (a 6-shaft papermakers' fabric of a single layer twill weave of the present invention) (Example 1).

Figure 14:
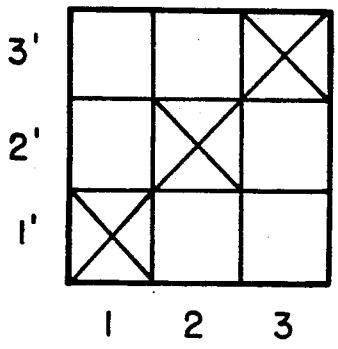
FIG.14 PRIOR ART
FIG. 14 is a complete design of the fabric of a 3-shaft papermakers' fabric of a single layer 2/1 twill weave (prior art)

FIG. 14 is a complete design of the fabric of a 3-shaft papermakers' fabric of a single layer 2/1 twill weave (Comparative Example 1).

Figure 15:
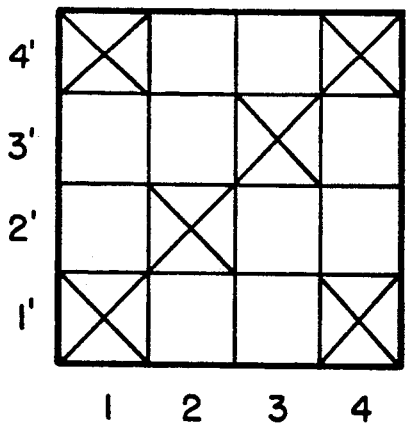
FIG.15 PRIOR ART
FIG. 15 is a complete design of the fabric of a 4-shaft papermakers' fabric of a single layer twill weave (prior art)

FIG. 15 is a complete design of the fabric of a 4-shaft papermakers' fabric of a single layer twill weave (Comparative Example 2).

Figure 16:
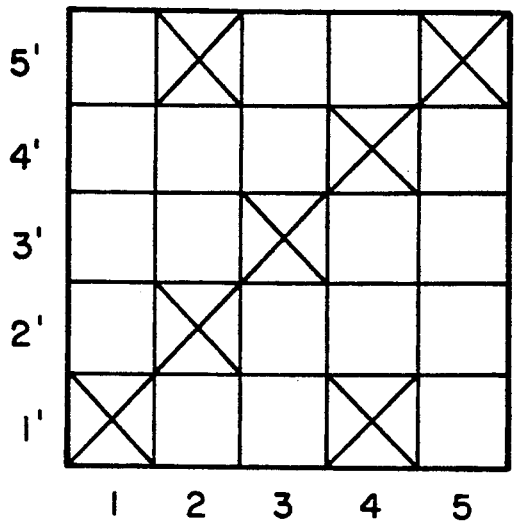
FIG.16 PRIOR ART
FIG. 16 is a complete design of the fabric of a 5-shaft papermakers' fabric of a single layer twill weave (prior art).

FIG. 16 is a complete design of the fabric of a 5-shaft papermakers' fabric of a single layer twill weave (Comparative Example 3).

The wefts and warps of each of the above fabrics employed in the experiments are shown in Table 2. In each FIGS., mark "X" indicates a position at which a warp forming paper-making surface is interlaced with a weft forming running side surface.

TABLE 2

| | Example 1 | Comp. Ex. 1 | Comp. Ex. 2 | Comp. Ex. 3 |
|---|---|---|---|---|
| Material of warp | polyester | polyester | polyester | polyester |
| Dia. of warp (mm) | 0.17 | 0.17 | 0.17 | 0.17 |
| Density of warp (No. every 25 mm) | 90 | 90 | 90 | 90 |
| Material of weft | polyester | polyester | polyester | polyester |
| Dia. of weft (mm) | 0.22 | 0.22 | 0.22 | 0.22 |
| Density of weft (No. every 25 mm) | 60 | 60 | 60 | 60 |
| Time taken before wefts torn off by wear (hour) | 29 | 17 | 20 | 8 (warps being torn off) |
| Sheet smoothness (sec.) | 96 | 99 | 72 | 65 |

Test method:

(Time taken before wefts being torn off by wear)

Tests were carried out using heavy calcium carbonate as the filler by the use of a wear tester (which is registered as Japanese Utility Model No. 1350124 and produced by Nippon Filcon Co., Ltd.).

(Smoothness)

Paper is actually manufactured by using each of the fabrics, and the smoothness of the surface of the paper to which the fabric is contacted is measured with Beck's smoothness tester.

EVALUATION

The fabric of Example 1 of the present invention was comparable to the fabric of Comparative Example 1 having no weft of long crimp with respect to the smoothness of paper which is generally influenced by the wire-marking property and fibers-supporting property, but indicated a prominent improvement in wear resistance.

The fabric of Comparative Example 2, wherein wefts of long crimp are formed therein, but in shorter size, i.e. 1.5 times or less as long as that of the short crimp, indicated a slight improvement in wear resistance as compared with the fabric of Comparative Example 1, but was by far inferior as compared with the fabric of Example 1 of the present invention. In addition to that, the smoothness of paper obtained by using the fabric of Comparative Example 2 was very poor.

In the case of fabric of Comparative Example 3 wherein there are some short crimps crossing only one warp, the warps were torn off faster than the wefts, indicating that the service life of Comparative Example 3 is by far inferior to that of Comparative Example 1, not to speak of the fabric of the present invention. In addition to that, the smoothness of paper obtained by using the fabric of Comparative Example 3 was very poor.

What is claimed is:

1. A weft-wear type n-shaft papermakers' fabric having a running side surface and a papermaking side surface, having improved wear resistance n is an integer of at least 6, which comprises warps, and wefts forming the running side surface to provide a wear-resistant surface of the papermakers' fabric, the wefts on the running side consisting of both short crimp-forming wefts, said short crimp crossing two or more warps, and long crimp-forming wefts, said long crimp having a length more than 1.5 times as long as that of said short crimp.

2. A weft-wear type papermakers' fabric according to claim 1, wherein said long crimp has a length twice or more as long as that of said short crimp.

3. A weft-wear type papermakers' fabric according to claim 1, wherein said long crimp-forming wefts and short crimp-forming ones are used in a ratio of from 3:1 to 1:3.

4. A weft-wear type papermakers' fabric according to claim 1, wherein in the fabric all of said long crimps are of the same length and said short crimps are of the same length, and, all of further, said long crimp-forming wefts and said short crimp-forming ones are alternately arranged in the fabric.

5. A weft-wear type papermakers' fabric according to claim 1, wherein said long crimp-forming wefts have a larger diameter than said short crimp-forming wefts.

6. A weft-wear type papermakers' fabric according to claim 1, wherein said long crimp-forming wefts are made of polyamide.

* * * * *